United States Patent [19]

Tanaka et al.

[11] Patent Number: 4,530,324

[45] Date of Patent: Jul. 23, 1985

[54] FUEL INJECTION PUMP FOR AN INTERNAL COMBUSTION ENGINE

[75] Inventors: Toshiaki Tanaka, Chigasaki; Hiroaki Miyazaki, Kamakura; Yukihiro Etoh, Yokohama; Nobukazu Kanesaki; Akihiro Iijima, both of Yokosuka, all of Japan

[73] Assignee: Nissan Motor Company, Limited, Yokohama, Japan

[21] Appl. No.: 527,775

[22] Filed: Aug. 30, 1983

[30] Foreign Application Priority Data

Oct. 14, 1982 [JP] Japan ..... 57-180363

[51] Int. Cl.[3] ..... F02B 3/00

[52] U.S. Cl. ..... 123/300; 123/501; 123/450; 417/462

[58] Field of Search ..... 123/299, 300, 502, 501, 123/450, 449; 417/462, 426

[56] References Cited

U.S. PATENT DOCUMENTS

| | | | |
|---|---|---|---|
| 4,173,959 | 11/1979 | Sosnowski et al. | 123/501 |
| 4,224,903 | 9/1980 | Mowbray | 123/300 |
| 4,265,200 | 5/1981 | Wessel et al. | 123/501 |
| 4,299,542 | 11/1981 | Potter et al. | 123/501 |
| 4,367,714 | 1/1983 | Di Domenico et al. | 123/449 |

FOREIGN PATENT DOCUMENTS

| | | | |
|---|---|---|---|
| 3010729 | 10/1981 | Fed. Rep. of Germany | 123/450 |
| WO82/03891 | 11/1982 | PCT Int'l Appl. . | |
| 1053287 | 12/1966 | United Kingdom . | |
| 1218026 | 1/1971 | United Kingdom | 123/502 |
| 2033959 | 5/1980 | United Kingdom | 123/450 |
| 2054754 | 2/1981 | United Kingdom | 123/450 |

OTHER PUBLICATIONS

U.S. Ser. No. 495,661 filed May 18, 1983, inventor: Yoshihisa Kawamura et al.

*Primary Examiner*—Magdalen Y. C. Moy

*Attorney, Agent, or Firm*—Schwartz, Jeffery, Schwaab, Mack, Blumenthal & Evans

[57] ABSTRACT

A first plunger pump serves to inject fuel into the combustion chamber of an internal combustion engine during first periodical compression strokes as the crankshaft of the engine rotates. A second plunger pump serves to inject fuel into the combustion chamber during second periodical compression strokes as the crankshaft rotates. The maximum fuel injection quantity during each second compression stroke of the second plunger pump is smaller than that during each first compression stroke of the first plunger pump. A sensor detects load on the engine. A mechanism serves to advance the timing of the first compression strokes relative to that of the second compression strokes with respect to the rotational angle of the crankshaft as the detected engine load increases. The characteristic curve of the rate of the sum of the fuel injections effected by the first and second plunger pumps with respect to the rotational angle of the crankshaft can vary in accordance with the engine load.

10 Claims, 19 Drawing Figures

FUEL INJECTION PUMP FOR AN INTERNAL COMBUSTION ENGINE

BACKGROUND OF THE INVENTION

This invention relates to a fuel injection pump for an internal combustion engine, such as a diesel engine.

Diesel engines are supplied with fuel by means of fuel injection pumps, which pressurize fuel periodically with respect to rotation of the engine crankshaft to effect fuel injection into the engine combustion chambers at a desired timing. As soon as fuel is injected into the combustion chambers, the fuel encounters highly compressed and heated air so that it burns spontaneously. Thus, the time of the initiation of fuel injection is an essential parameter determining fuel combustion characteristics. The variation of the rate of fuel injection with the rotational angle of the crankshaft during each fuel injection stroke also affects fuel combustion characteristics.

Especially for vehicular engines, desired characteristic curves or patterns of the fuel injection rate versus crank angles depend on the operating conditions of the engine, such as engine load. At lower loads, the fuel injection curve should be platykurtic so that the fuel injection quantity, and thus combustion chamber temperature and pressure, build up gradually. This minimizes synthesis of harmful nitrogen oxide (NOx) exhaust. On the other hand, in order to ensure adequate power output, the fuel injection curve at higher loads should be leptokurtic to induce intense combustion. This also minimizes synthesis of undesirable hydrocarbon (HC) exhaust, smoke, and particulates.

A fuel injection pump has been developed which realizes variable characteristic curves or patterns of the fuel injection rate. However, this fuel injection pump is relatively crude.

SUMMARY OF THE INVENTION

It is an object of this invention to provide a sophisticated fuel injection pump for an internal combustion engine which can adjust fuel injection rate characteristic curves or patterns.

According to this invention, a fuel injection pump applied to an internal combustion engine having a rotatable crankshaft and a combustion chamber includes first and second plunger pumps. The first plunger pump serves to inject fuel into the combustion chamber during first periodical compression strokes as the crankshaft rotates. The second plunger pump serves to inject fuel into the combustion chamber during second periodical compression strokes as the crankshaft rotates. The maximum fuel injection quantity during each second compression stroke of the second plunger pump is smaller than that during each first compression stroke of the first plunger pump. A sensor detects load on the engine. A mechanism serves to advance the timing of the first compression strokes relative to the timing of the second compression storkes with respect to the rotational angle of the crankshaft as the detected engine load increases. The characteristic curve of the rate of the sum of the fuel injections effected by the first and second plunger pumps with respect to the rotational angle of the crankshaft can vary in accordance with the engine load.

The above and other objects, features and advantages of this invention will be apparent from the following description of preferred embodiments thereof, taken in conjunction with the drawings.

BRIEF DESCRIPTION OF THE DRAWINGS

Like elements or parts are denoted by like reference numerals throughout the drawings.

DESCRIPTION OF THE PREFERRED EMBODIMENTS

Figure 1:
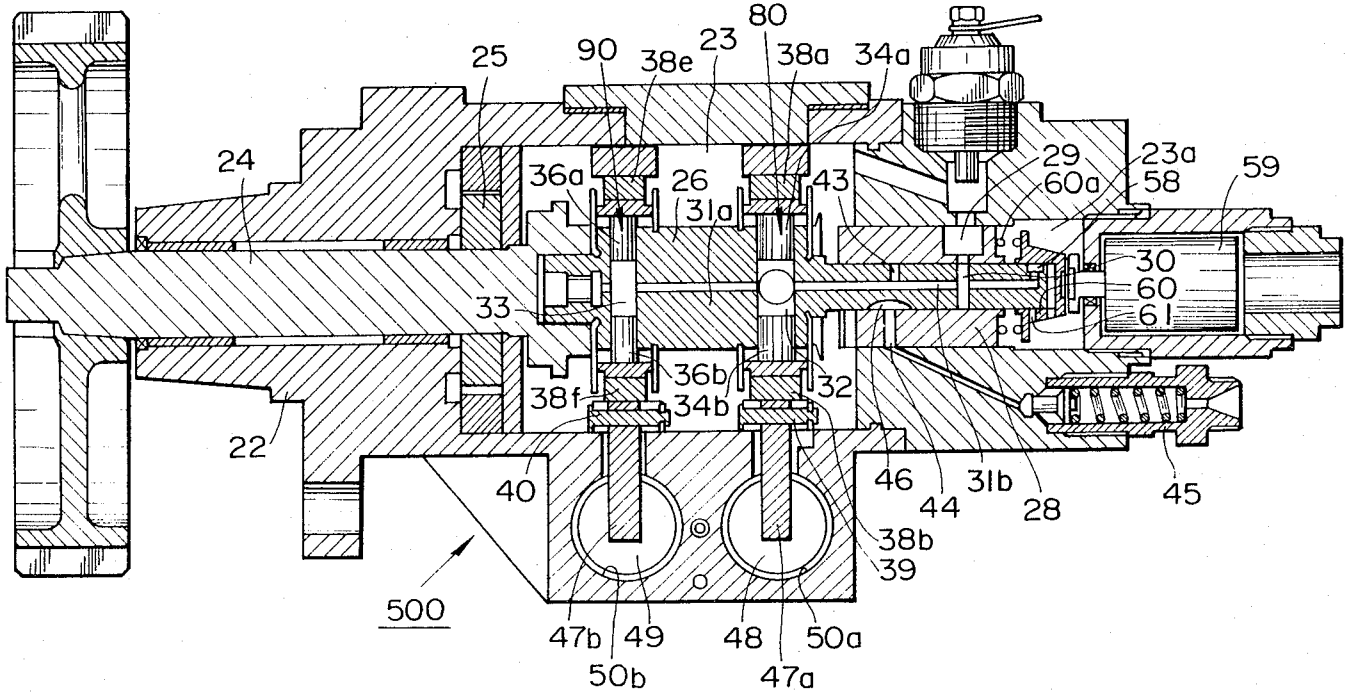
FIG. 1 is a sectional view of a fuel injection pump according to a first embodiment of this invention taken along the vertical plane including the longitudinal axis of the pump.

With reference to FIG. 1, a distribution-type fuel injection pump 500 for a diesel-type internal combustion engine includes a housing 22 and a drive shaft 24 rotatably extending into the housing 22. The drive shaft 24 protruding from the housing 22 is coupled to the crankshaft of the engine in a conventional way so as to rotate about its axis at half the speed of rotation of the crankshaft.

A transfer pump 25 located within the housing 22 is mounted on the drive shaft 24 to be driven by the engine. The transfer pump 25 draws fuel from a fuel tank (not shown) via a fuel inlet (not shown) and then drives fuel into a fuel reservoir or chamber 23 defined within the housing 22.

A cylindrical fuel-distributing rotor 26 disposed within the housing 22 is coaxially connected to the drive shaft 24 to rotate about its axis in conformity with rotation of the drive shaft 24. The rotor 26 rotatably extends through a sleeve 28 secured to the housing 22.

A fuel intake port 29 formed in the walls of the housing 22 and the sleeve 28 extends from the fuel chamber 23 to the inner surface of the sleeve 28. The rotor 26 has radial fuel intake passages 30, the number of which equals that of the combustion chambers of the engine. The outer ends of the intake passages 30 opening onto the periphery of the rotor 26 are spaced circumferentially with respect to the rotor 26 at equal angular intervals and are in the same axial position as the inner end of the intake port 29. As the rotor 26 rotates, the intake port 29 moves into and out of register or communication with each of the intake passages 30 sequentially. The rotor 26 is formed with first and second high-pressure or pumping chambers 32 and 33 which communicate with each other through a first axial passage 31*a* formed in the rotor 26. A second axial passage 31*b* formed in the rotor 26 extends from the inner ends of the intake passages 30 to the first pumping chamber 32. When the intake port 29 communicates with the intake passages 30, fuel can be driven out of the reservoir 23 toward the pumping chambers 32 and 33 via the intake port 29, the intake passages 30, and the axial passages 31*a* and 31*b*.

The rotor 26 has a radial fuel discharge passage 43, the inner end of which opens into the axial passage 31*b* and the outer end of which opens onto the periphery of the rotor 26 located in the sleeve 28. The walls of the sleeve 28 and the housing 22 define a set of fuel delivery ports 44 extending from the inner surface of the sleeve 28 to the outer surface of the housing 22. The inner ends of the delivery ports 44 are spaced circumferentially with respect to the sleeve 28 at equal angular intervals and are in the same axial position as the discharge passage 43. As the rotor 26 rotates, the discharge passage 43 moves into and out of register or communication with each of the delivery ports 44 sequentially. Thus, fuel can be directed from the pumping chambers 32 and 33 toward the delivery ports 44 via the axial passages 31*a* and 31*b*, and the discharge passage 43 when the discharge passage 43 comes into communication with the delivery ports 44. The number of the delivery ports 44 is equal to that of the combustion chambers of the engine. Each of the delivery ports 44 leads via a check-type delivery valve 45 to a fuel injection valve or nozzle (not shown) designed to inject fuel into the associated combustion chamber of the engine.

Figure 2:
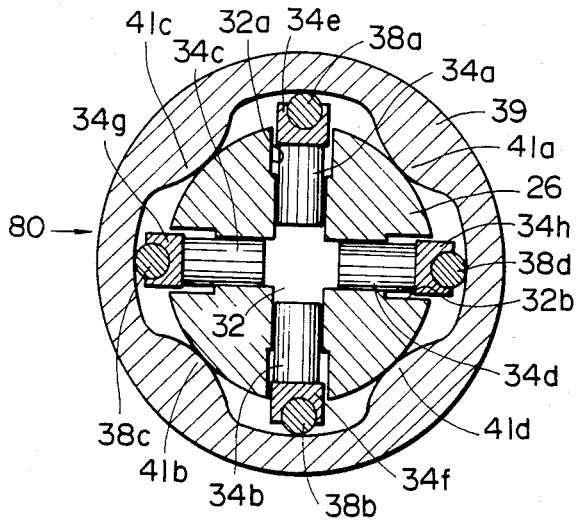
FIG. 2 is a cross-sectional view of the first cam ring and the rotor with associated parts of FIG. 1.

As shown in FIG. 2, the rotor 26 has a pair of interconnected diametrical bores 32*a* and 32*b* extending perpendicularly to each other. A pair of spaced plungers 34*a* and 34*b* are slidably disposed in the first bore 32*a*. The plungers 34*a* and 34*b* extend radially with respect to the rotor 26. Another pair of spaced plungers 34*c* and 34*d* are slidably disposed in the second bore 32*b*. The plungers 34*c* and 34*d* extend radially with respect to the rotor 26. The inner ends of the plungers 34*a*, 34*b*, 34*c*, and 34*d* cooperate to define the first pumping chamber 32 in conjunction with the bores 32*a* and 32*b*.

Figure 3:
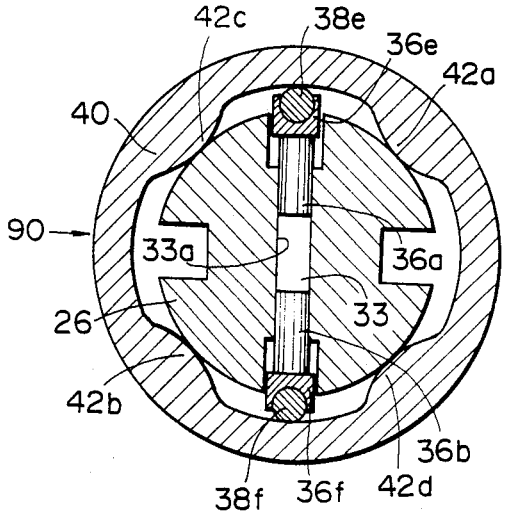
FIG. 3 is a cross-sectional view of the second cam ring and the rotor with associated parts of FIG. 1.

As shown in FIG. 3, the rotor 26 has a diametrical bore 33*a*, in which a pair of spaced plungers 36*a* and 36*b* are slidably disposed. The plungers 36*a* and 36*b* extend radially with respect to the rotor 26. The inner ends of the plungers 36*a* and 36*b* cooperate to define the second pumping chamber 33 in conjunction with the bore 33*a*. The displacement or variable volume of the second pumping chamber 33 is chosen to be smaller than that of the first pumping chamber 32 (see FIGS. 1 and 2). To this end, the diameter of the bore 33*a* is preferably designed to be smaller than that of the bores 32*a* and 32*b*. The bore 33*a* extends in the same diametrical direction as the bore 32*a* (see FIG. 2), so that the plungers 36*a* and 36*b* extend in the same radial directions as the plungers 34*a* and 34*b* respectively.

As shown in FIG. 2, roller shoes or holders 34*e*, 34*f*, 34*g*, and 34*h* are fixed to the outer ends of the plungers 34*a*, 34*b*, 34*c*, and 34*d*, respectively. A set of rollers 38*a*, 38*b*, 38*c*, and 38*d* extending axially with respect to the rotor 26 are rotatably retained by the shoes 34*e*, 34*f*, 34*g*, and 34*h*, respectively. The part of each of the rollers 38*a*, 38*b*, 38*c*, and 38*d* exposed by the shoes 34*e*, 34*f*, 34*g*, and 34*h* engages the inner surface of a first cam ring 39 concentrically surrounding the rotor 26. The cam ring 39 is disposed within and supported on the housing 22 (see FIG. 1). The inner surface of the cam ring 39 has a set of cam protrusions 41*a*, 41*b*, 41*c*, and 41*d*, which are spaced circumferentially at equal angular intervals, as are the rollers 38*a*, 38*b*, 38*c*, and 38*d*. The number of the cam protrusions 41*a*, 41*b*, 41*c*, and 41*d* equals that of the combustion chambers of the engine. As the rotor 26 rotates, the rollers 38*a*, 38*b*, 38*c*, and 38*d* rotate about the axis of the rotor 26 and also about their own axes while remaining in contact with the inner surface of the cam ring 39. It should be noted that rotation of the rotor 26 exerts centrifugal forces on the rollers 38*a*, 38*b*, 38*c*, and 38*d* which help them remain in contact with the cam ring 39. When the rollers 38*a*, 38*b*, 38*c*, and 38*d* "ascend" the cam protrusions 41*a*, 41*b*, 41*c*, and 41*d* in accordance with rotation of the rotor 26, the plungers 34*a*, 34*b*, 34*c*, and 34*d* are displaced radially inward, thereby contracting the pumping chamber 32. When the rollers 38*a*, 38*b*, 38*c*, and 38*d* "descend" the cam protrusions 41*a*, 41*b*, 41*c*, and 41*d* in accordance with rotation of the rotor 26, the plungers 34*a*, 34*b*, 34*c*, and 34*d* are displaced radially outward, thereby expanding the pumping chamber 32.

As shown in FIG. 3, roller shoes or holders 36*e* and 36*f* are fixed to the outer ends of the plungers 36*a* and 36*b*, respectively. A pair of rollers 38*e* and 38*f* extending axially with respect to the rotor 26 are rotatably retained by the shoes 36*e* and 36*f*, respectively. The part of each of the rollers 38*e* and 38*f* exposed by the shoes 36*e* and 36*f* engages the inner surface of a second cam ring 40 concentrically surrounding the rotor 26. The cam ring 40 is disposed within and supported on the housing 22, and is axially spaced from the first ring 39 (see FIGS. 1 and 2). The inner surface of the cam ring 40 has a set of cam protrusions 42*a*, 42*b*, 42*c*, and 42*d* in the same manner as the inner surface of the first cam ring 39. As the rotor 26 rotates, the rollers 38*e* and 38*f* rotate about the axis of the rotor 26 and also about their own axes while remaining in contact with the inner surface of the cam ring 40. It should be noted that rotation of the rotor 26 exerts centrifugal forces on the rollers 38*e* and 38*f* which help them remain in contact with the cam ring 40. When the rollers 38*e* and 38*f* "ascend" the cam protrusions 42*a*, 42*b*, 42*c*, and 42*d* in accordance with rotation of the rotor 26, the plungers 36*a* and 36*b* are displaced radially inward, thereby contracting the pumping chamber 33. When the rollers 38*e* and 38*f* "descend" the cam protrusions 42*a*, 42*b*, 42*c*, and 42*d* in accordance with rotation of the rotor 26, the plungers 36*a* and 36*b* are displaced radially outward, thereby expanding the working chamber 32.

When the pumping chambers 32 and 33 expand in accordance with rotation of the rotor 26, the intake port 29 generally remains in communication with one of the intake passages 30 so that fuel is directed from the reservoir 23 toward the pumping chambers 32 and 33 via the intake port 29, the intake passage 30, and the axial passages 31*a* and 31*b*. In this way, the fuel intake stroke is effected. When the pumping chambers 32 and 34 contract in accordance with rotation of the rotor 26, the discharge passage 43 generally remains in communication with one of the delivery ports 44 so that fuel is forced out of the pumping chambers 32 and 33 toward the delivery port 44 via the axial passages 31*a* and 31*b*, and the discharge passage 43. Then, the pressurized fuel is directed along the delivery port 44 toward the associated injection valve via the delivery valve 45 before being injected into the associated combustion chamber of the engine via the injection valve. In this way, fuel injection stroke is effected.

The combination of the plungers 34*a*, 34*b*, 34*c*, and 34*d*, the first cam ring 39, and the associated elements constitute a first plunger pump 80 including the first pumping chamber 32. The combination of the plungers 36*a* and 36*b*, the second cam ring 40, and the associated elements constitute a second plunger pump 90 including the second pumping chamber 33.

The rotor 26 is formed with an axial groove 46 opposite the outer end of the discharge passage 43. As the rotor 26 rotates, the axial groove 46 moves into and out of register or communication with each of the delivery ports 44 sequentially. When the axial groove 46 comes into communication with the delivery ports 44, the residual or trapped pressure in the delivery ports 44 is lowered to an acceptable level.

Figure 4:
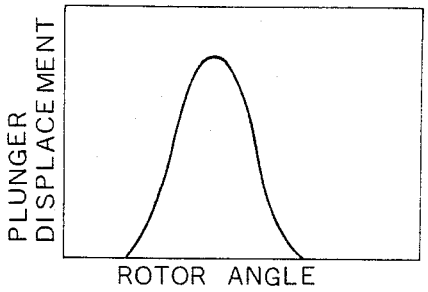
FIG. 4 is a diagram showing the relationship between the displacement of the plungers and the rotational angle of the rotor for the first plunger pump of FIG. 1.
Figure 5:
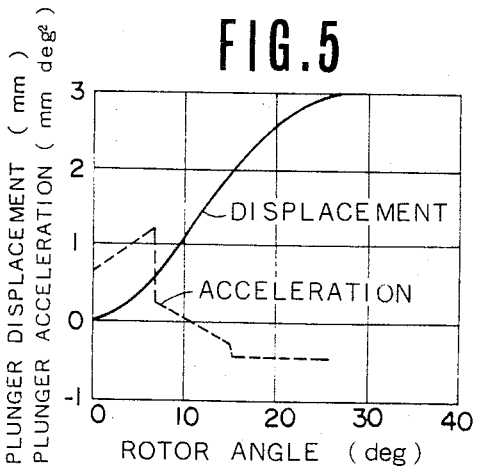
FIG. 5 is a diagram showing the same relationship as shown in FIG. 4 and also the relationship between the acceleration of the plungers and the rotational angle of the rotor for the first plunger pump of FIG. 1.

The profile of the cam protrusions 41*a*, 41*b*, 41*c*, and 41*d* is designed so that radial lift or displacement of the plungers 34*a*, 34*b*, 34*c*, and 34*d* varies in accordance with rotational angle of the rotor 26 relative to the first cam ring 39 as shown by the solid curves in FIGS. 4 and 5. In this case, radial acceleration of the plungers 34*a*, 34*b*, 34*c*, and 34*d* varies in accordance with rotational angle of the rotor 26 relative to the first cam ring 39 as shown by the broken line in FIG. 5.

Figure 6:
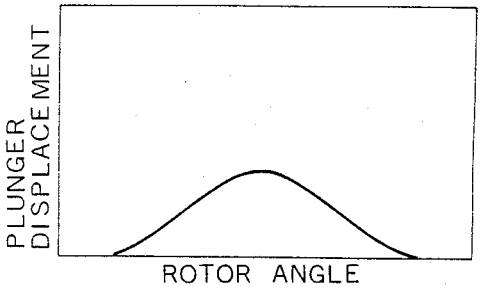
FIG. 6 is a diagram showing the relationship between the displacement of the plungers and the rotational angle of the rotor for a second plunger pump of FIG. 1.
Figure 7:
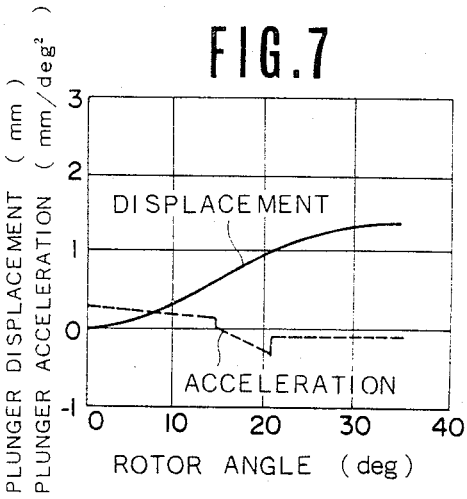
FIG. 7 is a diagram showing the same relationship as shown in FIG. 4 and also the relationship between the acceleration of the plungers and the rotational angle of the rotor for the second plunger pump of FIG. 1.

The profile of the cam protrusions 42*a*, 42*b*, 42*c*, and 42*d* is designed so that radial lift or displacement of the plungers 36*a* and 36*b* varies in accordance with rotational angle of the rotor 26 relative to the second cam ring 40 as shown by the solid curves in FIGS. 6 and 7. In this case, radial acceleration of the plungers 36*a* and 36*b* varies in accordance with rotational angle of the rotor 26 relative to the second cam ring 40 as shown by the broken line in FIG. 7.

As is apparent from FIGS. 4, 5, 6, and 7, the characteristic curve of displacement of the plungers 34*a*, 34*b*, 34*c*, and 34*d* versus rotational angle of the rotor 26 is leptokurtic, while that of displacement of the plungers 36*a* and 36*b* versus rotational angle of the rotor 26 is relatively platykurtic. Specifically, the peak of the displacement of the plungers 34*a*, 34*b*, 34*c*, and 34*d* is considerably higher than that of the displacement of the plungers 36*a* and 36*b*. Furthermore, the duration in terms or units of rotational angle of the rotor 26 or crank angle of the engine for which the displacement of the plungers 34*a*, 34*b*, 34*c*, and 34*d* occurs is smaller than that for which the displacement of the plungers 36*a* and 36*b* occurs. The average of the absolute values of acceleration of the plungers 34*a*, 34*b*, 34*c*, and 34*d* is considerably greater than that of the absolute values of acceleration of the plungers 36*a* and 36*b*.

Figure 13:
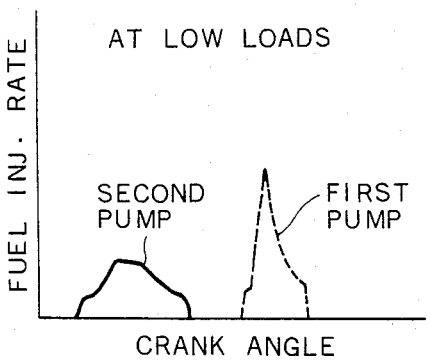
FIGS. 13, 14, and 15 are representative diagrams of the relationship between the fuel injection rate and the crank angle at low engine loads, partial or intermediate engine loads, and high engine loads, respectively, in which the broken lines relate to the first plunger pump of FIG. 1 and the solid lines relate to the second plunger pump of FIG. 1.
Figure 14:
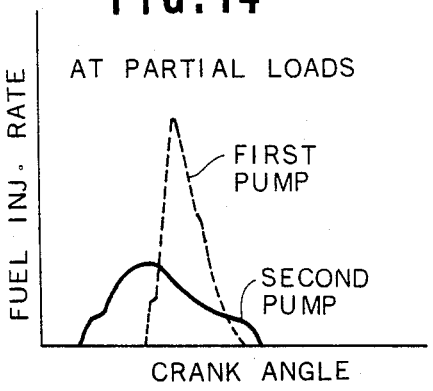
Figure 15:
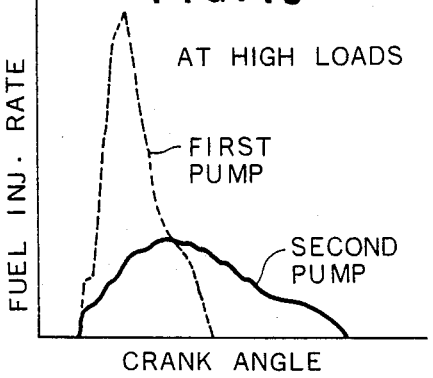

As shown by the broken lines in FIGS. 13 to 15, the rate of fuel injection effected by the first plunger pump 80 varies with crank angle of the engine. As shown by the solid lines in FIGS. 13 to 15, the rate of fuel injection effected by the second plunger pump 90 also varies with crank angle of the engine. Specifically, the fuel injection characteristic curve of the first plunger pump 80 with respect to crank angle of the engine has a considerably higher peak and indicates a remarkably smaller fuel injection duration than those of the fuel injection characteristic curve of the second plunger pump 90 with respect to crank angle of the engine, since the plunger displacement characteristic curve of the first plunger pump 80 with respect to crank angle of the engine is leptokurtic and that of the second plunger pump 90 with respect to crank angle of the engine is platykurtic as described previously. In other words, as the crank angle of the engine advances, the rate of fuel injection effected by the first plunger pump 80 increases steeply from zero to its peak and returns rapidly from the peak to zero while the rate of fuel injection effected by the second plunger pump 90 increases gradually from zero to its peak and decreases progressively from the peak to zero.

The first cam ring 39 is pivotable relative to the housing 22 in both circumferential directions, that is, in the directions equal to and opposite the direction of rotation of the rotor 26. Pivoting the cam ring 39 in the direction opposite that of rotation of the rotor 26 causes an advance of timing, in regard to rotational angle of the rotor 26 and thus to crank angle of the engine, at which the rollers 38*a*, 38*b*, 38*c*, and 38*d* encounter the cam protrusions 41*a*, 41*b*, 41*c*, and 41*d*. Such a pivotal displacement of the cam 39, thus, results in an advance of timing of fuel injection effected by the first plunger pump 80. Pivoting the cam ring 39 in the direction of rotation of the rotor 26 causes a retardation of timing, in regard to rotational angle of the rotor 26 and thus to crank angle of the engine, at which the rollers 38*a*, 38*b*, 38*c*, and 38*d* encounter the cam protrusions 41*a*, 41*b*, 41*c*, and 41*d*. Such a pivotal displacement of the cam ring 39, thus, results in a retardation of timing of fuel injection effected by the first plunger pump 80. In this way, the angular position of the cam ring 39 relative to the housing 22 determines the timing of fuel injection, in regard to crank angle of the engine, effected by the first plunger pump 80.

The second cam ring 40 is pivotable in a manner similar to that of the first cam ring 39. Pivoting the cam ring 40 in the direction opposite the direction of rotation of the rotor 26 causes an advance of timing, in regard to rotational angle of the rotor 26 and thus to crank angle of the engine, at which the rollers 38*e* and 38*f* encounter the cam protrusions 42*a*, 42*b*, 42*c*, and 42*d*. Pivoting the cam ring 40 in the direction of rotation of the rotor 26 causes a retardation of timing at which the rollers 38*e* and 38*f* encounter the cam protrusions 42*a*, 42*b*, 42*c*, *and* 42*d*. In this way, the angular position of the cam ring 40 relative to the housing 22 determines the timing of fuel injection, in regard to crank angle of the engine, effected by the second plunger pump 90.

Figure 8:
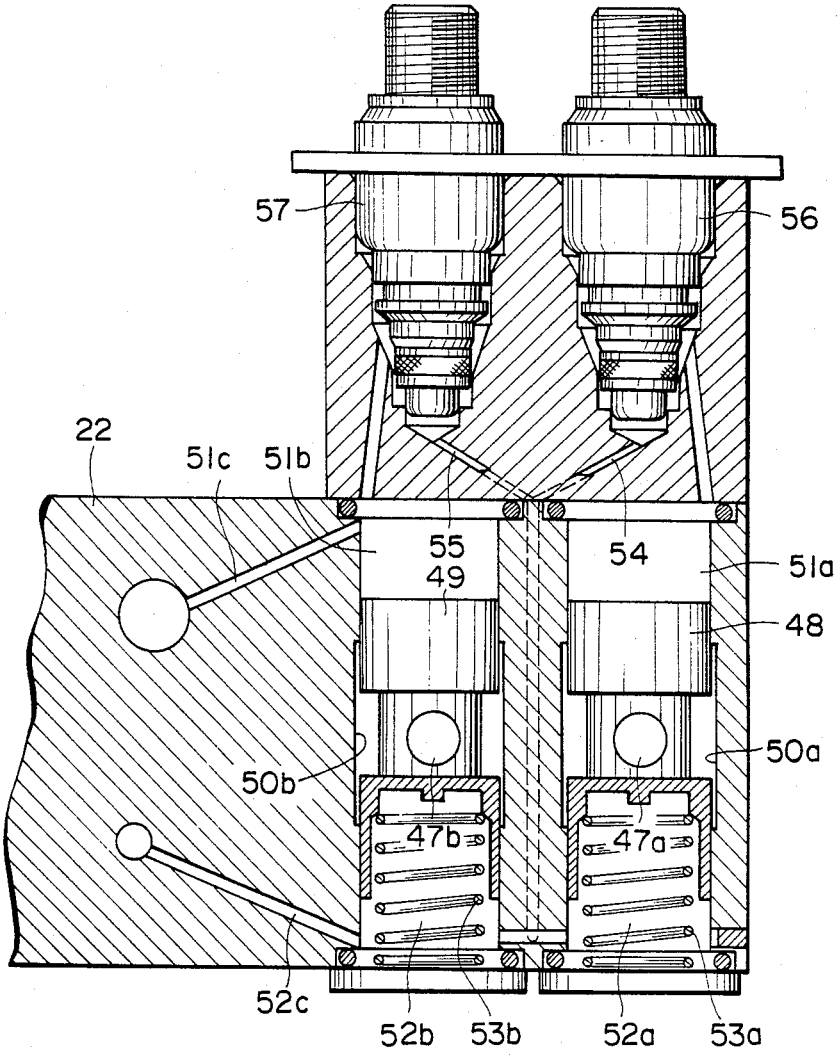
FIG. 8 is a sectional view of a fuel injection timing control device included in the fuel injection pump of FIG. 1.

As shown in FIGS. 1 and 8, a timer piston 48 is slidably disposed in a blind bore 50*a* defined in the walls of the housing 22 directly below the first cam ring 39. The axis of the bore 50*a* lies perpendicularly to the axis of the cam ring 39 so that the timer piston 48 can move perpendicularly to the axis of the cam ring 39. One end of the timer piston 48 defines a primary pressure chamber 51*a*, and the other end of the piston 48 defines a secondary pressure chamber 52*a*. The primary chamber 51*a* communicates with the reservoir 23 and thus with the outlet of the transfer pump 25 via a passage (not shown) provided with an orifice or restriction, so that the primary chamber 51*a* can be supplied with the pressure of fuel at the outlet of the transfer pump 25. The secondary chamber 52*a* communicates with the inlet of the transfer pump 25 via a passage (not shown), so that the secondary chamber 52*a* can be supplied with the pressure of fuel at the inlet of the transfer pump 25 which is normally lower than the pressure of fuel at the outlet thereof. A compression spring 53*a* disposed in the secondary chamber 52*a* seats between the housing 22 and the timer piston 48 to urge the piston 48 toward the primary chamber 51*a*. The displacement of the timer piston 48 depends on the difference in pressure between the primary and the secondary chambers 51*a* and 52*a*. The timer piston 48 is coupled to the first cam ring 39 via a connecting rod 47*a* so that the displacement of the timer piston 48 causes angular displacement of the cam ring 39 relative to the housing 22. Therefore, the timing of fuel injection effected by the first plunger pump 80 depends on the difference in pressure between the primary and the secondary chambers 51*a* and 52*a*.

The primary chamber 51*a* and the secondary chamber 52*a* are interconnected via a passage 54 defined in the walls of the housing 22. An ON-OFF electromagnetic or solenoid valve 56 attached to the housing 22 serves to block and open the interconnecting passage 54. When the solenoid valve 56 is electrically energized and deenergized, the valve 56 opens and blocks the passage 54 respectively. As the passage 54 is opened and blocked, the difference in pressure between the primary and secondary chambers 51*a* and 52*a* drops and rises respectively. If the solenoid valve 56 is electrically driven by a pulse signal with a relatively high frequency, the difference in pressure between the primary and the secondary chambers 51*a* and 52*a* is held at a essentially constant level which depends on the duty cycle of the driving pulse signal. As a result, the timing of fuel injection effected by the first plunger pump 80 can be adjusted via control of the duty cycle of the driving pulse signal applied to the solenoid valve 56.

A second timer piston 49 is slidably disposed in a blind bore 50*b* defined in the walls of the housing 22 directly below the second cam ring 40. The axis of the bore 50*b* lies perpendicularly to the axis of the cam ring 40 so that the timer piston 49 can move perpendicularly to the axis of the cam ring 40. One end of the timer piston 49 defines a primary pressure chamber 51*b*, and the other end of the piston 49 defines a secondary pressure chamber 52*b*. The primary chamber 51*b* communicates with the reservoir 23 and thus with the outlet of the transfer pump 25 via a passage 51*c* provided with an orifice or restriction (not shown), so that the primary chamber 51*b* can be supplied with the pressure of fuel at the outlet of the transfer pump 25. The secondary chamber 52*b* communicates with the inlet of the transfer pump 25 via a passage 52*c*, so that the secondary chamber 52*b* can be supplied with the pressure of fuel at the inlet of the transfer pump 25 which is normally lower than the pressure of fuel at the outlet thereof. A compression spring 53*b* disposed in the secondary chamber 52*b* seats between the housing 22 and the timer piston 49 to urge the piston 49 toward the primary chamber 51*b*. The displaceent of the timer piston 49 depends on the difference in pressure between the primary and the secondary chambers 51*b* and 52*b*. The timer piston 49 is coupled to the second cam ring 40 via a connecting rod 47*b* so that the displacement of the timer piston 49 causes angular displacement of the cam ring 40 relative to the housing 22. Therefore, the timing of fuel injection effected by the second plunger pump 90 depends on the difference in pressure between the primary and the secondary chambers 51*b* and 52*b*.

The primary chamber 51*b* and the secondary chamber 52*b* are interconnected via a passage 55 defined in the walls of the housing 22. A second ON-OFF electromagnetic or solenoid valve 57 attached to the housing 22 serves to block and open the interconnecting passage 55. When the solenoid valve 57 is electrically energized and de-energized, the valve 57 opens and blocks the passage 55 respectively. As the passage 55 is opened and blocked, the difference in pressure between the primary and the secondary chambers 51*b* and 52*b* drops and rises respectively. If the solenoid valve 57 is electrically driven by a pulse signal with a relatively high frequency, the difference in pressure between the primary and the secondary chambers 51*b* and 52*b* is held at an essentially constant level which depends on the duty cycle of the driving pulse signal. As a result, the timing of fuel injection effected by the second plunger pump 90 can be adjusted via control of the duty cycle of the driving pulse signal applied to the solenoid valve 57.

Figure 9:
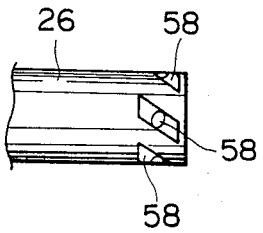
FIG. 9 is a side view of the end of the rotor of FIG. 1.
Figure 10:
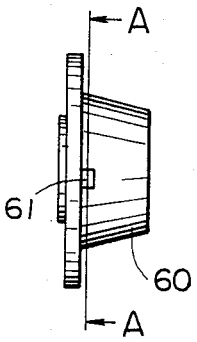
FIG. 10 is a side view of the fuel injection quantity adjusting cap fitted onto the end of the rotor of FIGS. 1 and 9.
Figure 11:
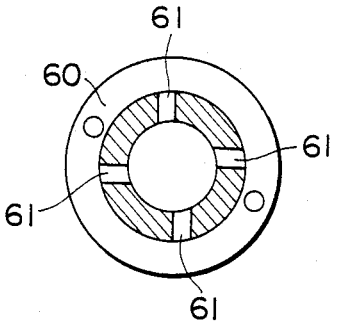
FIG. 11 is a cross-sectional view of the cap taken along the line A—A of FIG. 10.

As shown in FIG. 1, the outer end of the sleeve 28 and the walls of the housing 22 define a chamber 23*a* communicating with the reservoir 23 via a suitable passage (not shown). The rotor 26 projects from the sleeve 28 into the chamber 23*a*. As shown in FIGS. 1 and 9, the periphery of the end of the rotor 26 within the chamber 23*a* has relief ports or grooves 58 circumferentially spaced at equal intervals. The relief grooves 58 extend obliquely to the axis of the rotor 26. The number of the relief grooves 58 is equal to that of the combustion chambers of the engine. The axial passage 31*b* leads to the relief grooves 58 via radial passages (not designated). The end of the rotor 26 and the relief grooves 58 are covered by a control member or cap 60, which is disposed in the chamber 23*a* and is free to move axially with respect to the rotor 26 while permitting rotation of the rotor 26. As shown in FIGS. 1, 10, and 11, the control cap 60 has relief passages 61 extending therethrough in approximately radial directions with respect to the rotor 26. The inner ends of the relief passages 61 are spaced circumferentially with respect to the rotor 26 at equal angular intervals. The number of the relief passages 61 is equal to that of the relief grooves 58. The control cap 60 is movable only in the axial direction with respect to the rotor 26. The range of axial movement of the relief passages 61 is chosen so that they remain within the axial extent of the relief grooves 58. As the rotor 26 rotates, the relief grooves 58 move into and out of communication with the relief passages 61 sequentially. Since the relief passages 61 open to the chamber 23*a*, the relief grooves 58 can communicate with the chamber 23*a* via the relief passages 61. The control cap 60 blocks the relief grooves 58 while the relief passages 61 remain out of communication with the relief grooves 58.

During the fuel injection stroke, when the relief grooves 58 come into communication with the relief passages 61, fuel is returned from the pumping chambers 32 and 33 to the reservoir 23 via the axial passages 31*a* and 31*b*, the relief ports 58, the relief passages 61, and the chamber 23*a* and consequently fuel flow from the pumping chambers 32 and 33 toward the fuel injection nozzles is interrupted. In this way, communication between the relief grooves 58 and the relief passages 61 interrupts fuel injection. Since the relief grooves 58 are oblique to the axis of the rotor 26, the timing of communication between the relief grooves 58 and the relief passages 61 in terms of crank angle of the engine depends on the axial position of the control cap 60 relative to the rotor 26. As a result, the timing of the end of fuel injection in terms of crank angle of the engine depends on the axial position of the control cap 60 relative to the rotor 26, so that effective fuel injection stroke and thus fuel injection quantity during each fuel injection stroke vary as a function of the axial position of the control cap 60 relative to the rotor 26. The effective fuel injection stroke means the duration of fuel injection in terms or units of crank angle of the engine. The fuel injection quantity during each fuel injection stroke means the quantity of fuel injected during each fuel injection stroke.

It should be noted that the configuration of the relief grooves 58 and the relief passages 61 may be switched.

A linear electric motor 59 attached to the housing 22 has a linearly movable shaft (not designated) extending slidably into the chamber 23*a*. The shaft of the motor 59 lies in parallel to the axis of the rotor 26. The control cap 60 is coupled to the shaft of the motor 59, so that the axial position of the control cap 60 relative to the rotor 26 can be controlled by the motor 59. A spring 60*a* disposed in the chamber 23*a* seats between the housing 22 and the control cap 60 to urge the control cap 60 relative to the housing 22. The control cap 60 is held at an axial position where the force exerted on the control cap 60 by the spring 60*a* balances the force exerted on the control cap 60 by the motor 59.

Figure 12:
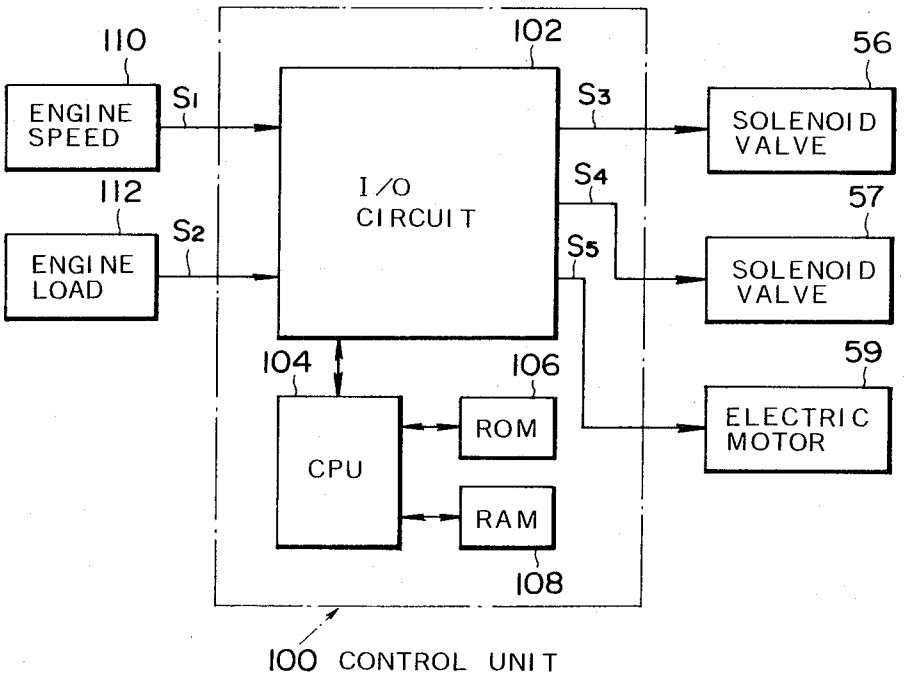
FIG. 12 is a block diagram of electrical circuitry controlling the solenoid valves and the electric motor of FIG. 1.

FIG. 12 shows an electrical control system, which includes a control unit 100 consisting of a microcomputer unit. The control unit 100 includes an input/output (I/O) circuit 102, a central processing unit (CPU) 104, a read-only memory (ROM) 106, and a random-access memory (RAM) 108. The central processing unit 104 is connected to the I/O circuit 102, and the memories 106 and 108.

A conventional engine speed sensor 110 is associated with the crankshaft or the camshaft of the engine to monitor the rotational speed of the engine and generate a signal $S_1$ indicative thereof. The engine speed sensor 110 is connected to the I/O circuit 102 to apply the signal $S_1$ thereto. A well-known engine load sensor 112 is associated with an accelerator pedal or the like whose position determines the power output required of the engine representing the engine load. The engine load sensor 112 detects the engine load and generates a signal $S_2$ indicative thereof. The engine load sensor 112 is also connected to the I/O circuit 102 to apply the signal $S_2$ thereto.

The control unit 100 generates signals $S_3$, $S_4$, and $S_5$ outputted by way of the I/O circuit 102. The solenoid valves 56 and 57, and the electric motor 59 are connected to the I/O circuit 102 to receive the signals $S_3$, $S_4$, and $S_5$, respectively. The signals $S_3$, $S_4$, and $S_5$ are intended to conrol the solenoid valves 56 and 57, and the electric motor 59. The control unit 100 adjusts the control signals $S_3$, $S_4$, and $S_5$ in response to the signals $S_1$ and $S_2$ in order to control the timing of fuel injection effected by the first plunger pump 80 (see FIG. 1), the timing of fuel injection effected by the second plunger pump 90 (see FIG. 1), and the fuel injection quantity during each fuel injection stroke in accordance with the sensed engine speed and load. The control signals $S_3$ and $S_4$ are in the form of a pulse train. The control unit 100 adjusts the duty cycles of the control signals $S_3$ and $S_4$ in response to the signals $S_1$ and $S_2$ to effect the fuel injection timing control. The control signals $S_5$ has a variable DC voltage or current. The control unit 100 adjusts the voltage or current of the control signal $S_5$ in response to the signals $S_1$ and $S_2$. The adjustment of the voltage or current of the control signal $S_5$ results in control of the intensity of the electrical energization of the electric motor 59. Since the axial position of the shaft of the electric motor 59 depends on the intensity of the electrical energization of the electric motor 59, the adjustment of the voltage or current of the control signal $S_5$ causes control of the fuel injection quantity during each fuel injection stroke.

The control unit 100 operates in accordance with a program stored in the memory 106. First, the control unit 100 derives the values of the current engine speed and load from the signals $S_1$ and $S_2$. On the basis of the engine speed value and the engine load value, the control unit 100 determines the desired timing of fuel injection effected by the first plunger pump 80 (see FIG. 1), the desired timing of fuel injection effected by the second plunger pump 90 (see FIG. 1), and the desired fuel injection quantity during each fuel injection stroke. In this step, the control unit 100 uses a known table look-up technique with interpolation. Specifically, the memory 106 holds three tables in which a set of desired fuel injection timing values relating to the first plunger pump 80, a set of desired fuel injection timing values relating to the second plunger pump 90, and a set of desired fuel injection quantity values are, respectively, plotted as functions of the engine speed and load. By referring to these tables and, if necessary, performing interpolation in accordance with the engine speed and load values, the control unit 100 determines the desired fuel injection timing values and the desired fuel injection quantity value. Then, the control unit 100 adjusts the control signals $S_3$, $S_4$, and $S_5$ in accordance with the desired fuel injection timing values and the desired fuel injection quantity value so that the actual fuel injection timings and the actual fuel injection quantity coincide with the desired fuel injection timing values and the desired fuel injection quantity value respectively.

The tables indicating the desired fuel injection timing values are designed such that the timings of possible fuel injections effected by the first and second plunger pumps 80 and 90 advance in terms or units of crank angle of the engine as the engine speed increases. In addition, as shown in FIGS. 13, 14, and 15, the timing of possible fuel injection performed by the first plunger pump 80 is advanced relative to the timing of possible fuel injection performed by the second plunger pump 90 as the engine load increases.

Specifically, at low engine loads as shown in FIG. 13, the timing of possible fuel injection effected by the first plunger pump 80 is considerably retarded from that effected by the second plunger pump 90. In fact, fuel injection via the first plunger pump 80 is so retarded as to not coincide at all with fuel injection due to the second plunger pump 90. At partial or intermediate engine loads as shown in FIG. 14, the fuel injection duration of the first plunger pump 80 falls completely within the fuel injection duration of the second plunger pump 90 while the peak fuel injection rate of the first plunger pump 80 is slightly retarded from that of the second plunger pump 90. At high engine loads as shown in FIG. 15, the fuel injection duration of the first plunger pump 80 fails completely within the fuel injection duration of the second plunger pump 90 while the peak fuel injection rate of the first plunger pump 80 is slightly in advance of that of the second plunger pump 90.

Figure 16:
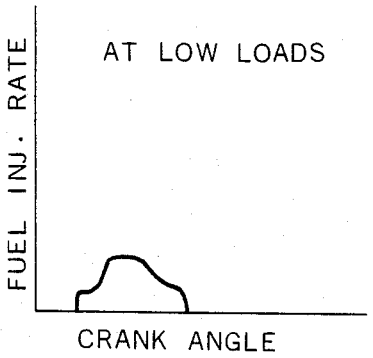
FIGS. 16, 17, and 18 are representative diagrams of the relationship between the total fuel injection rate and the crank angle at low engine loads, partial or intermediate engine loads, and high engine loads, respectively.
Figure 17:
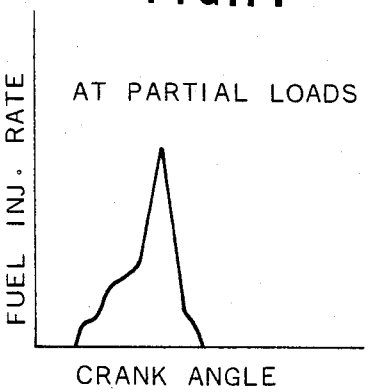
Figure 18:
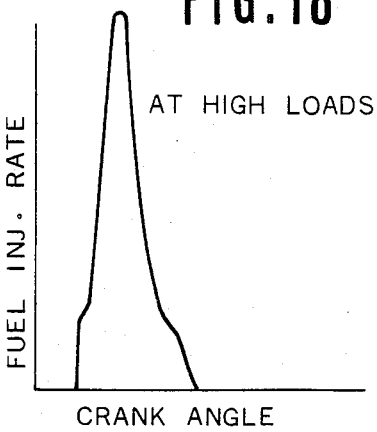

FIGS. 16 to 18 show characteristic curves of actual total fuel injection rate with respect to crank angle of the engine at low, partial or intermediate, and high engine loads, respectively. The total fuel injection is normally, but not always, the sum of that effected by the first plunger pump 80 and that effected by the second plunger pump 90, and depends on the fuel injection quantity control via the electric motor 59 (see FIGS. 1 and 12). Since the timing of fuel injection effected by the first plunger pump 80 advances relative to that of fuel injection effected by the second plunger pump 90 as the engine load increases, the characteristic curve of total fuel injection rate with respect to crank angle of the engine varies in accordance with the engine load. The fuel injection quantity control via the electric motor 59 also affects the characteristic curve of total fuel injection rate.

Specifically, at low engine loads as shown in FIG. 16, the fuel injection quantity control via the electric motor 59 generally serves to disable the fuel injection effected by the first plunger pump 80 so that the total fuel injection results only from the fuel injection effected by the second plunger pump 90. Therefore, as crank angle of the engine increases, the rate of total fuel injection increases gradually from zero to its peak and returns progressively from the peak to zero. This total fuel injection rate characteristic causes gradual and mild increases in the temperature and pressure in the engine combustion chambers, thereby minimizing synthesis of harmful nitrogen oxide ($NO_x$) exhaust. It should be noted that the fuel injection quantity control via the electric motor 59 can adjust the duration of fuel injection effected by the second plunger pump 90 in accordance with the engine load.

At partial or intermediate engine loads as shown in FIG. 17, the total fuel injection results from both of the fuel injection effected by the first plunger pump 80 and that effected by the second plunger pump 90. Therefore, as crank angle of the engine increases, the rate of total fuel injection increases gradually at first and then increases steeply to its peak and returns rapidly from the peak to zero. The first gradual increase in the total fuel injection rate reflects the increase in the fuel injection rate relating to the second plunger pump 90, while the steep increase in the total fuel injection rate reflects the increase in the fuel injection rate relating to the first plunger pump 80. This total fuel injection rate characteristic causes moderate increases in the temperature and pressure in the engine combustion chambers, thereby maintaining synthesis of harmful nitrogen oxide ($NO_x$) exhaust and undesirable hydrocarbon (HC) exhaust at acceptable levels while ensuring necessary engine power output. It should be noted that the fuel injection quantity control via the electric motor 59 can adjust the duration of total fuel injection in accordance with the engine load.

At high engine loads as shown in FIG. 18, the fuel injection quantity control performed by the electric motor 59 generally serves to substantially disable the latter part of the fuel injection effected by the second plunger pump 90 so that the total fuel injection results mainly from the fuel injection effected by the first plunger pump 80. Therefore, as the crank angle of the engine increases, the rate of total fuel injection increases steeply from zero to its peak and rapidly returns from the peak to zero. This total fuel injection rate characteristic causes intense increases in the temperature and pressure in the combustion chambers, thereby minimizing synthesis of undesirable hydrocarbon (HC) exhaust while ensuring adequate engine power output. It should be noted that the fuel injection quantity control via the electric motor can adjust the duration of fuel injection effected by the first plunger pump 80 in accordance with the engine load.

The second solenoid valve 57 and the interconnecting passage 55 may be eliminated. In this case, the timing of possible fuel injection effected by the second plunger pump 90 automatically advances as the engine speed increases, since the difference in pressure between the outlet and the inlet of the transfer pump 25 increases as the engine speed increases. The timing of possible fuel injection effected by the first plunger pump 80 is controlled via the first solenoid valve 56 in a way similar to that described previously. The fuel injection quantity during each fuel injection stroke is controlled via the electric motor 59 in a way similar to that described previously.

Figure 19:
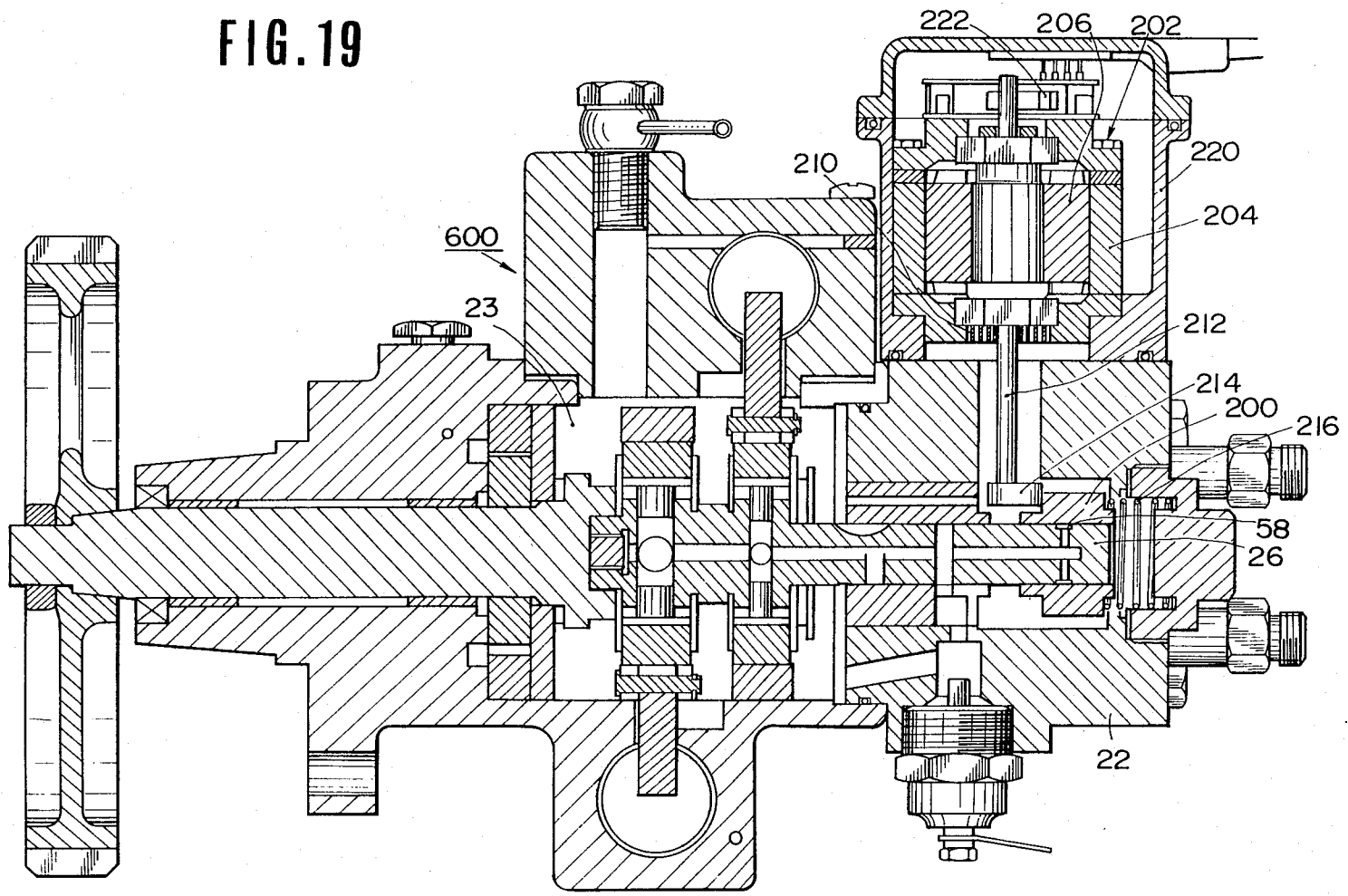
FIG. 19 is a sectional view of a fuel injection pump according to a second embodiment of this invention taken along the vertical plane inciuding the longitudinal axis thereof.

FIG. 19 shows a fuel injection pump 600 according to a second embodiment of this invention. A control member or sleeve 200 is coaxially, slidably mounted on the end of the rotor 26. The control sleeve 200 is designed in a manner substantially similar to that of the control cap 60 (see FIGS. 1, 10, 11) of the first embodiment so that the axial position of the control sleeve 200 will determine the fuel injection quantity during each fuel injection stroke. Specifically, the control sleeve 200 has relief passages (not shown) designed similarly to the passages 61 (see FIGS. 1, 10, and 11) and cooperating with the relief grooves 58 formed in the rotor 26. An electrically-powered actuator or torque motor 202 attached to the housing 22 includes a stationary permanent magnet 204 and a rotary member 206 on which a control winding is mounted. A return spring 210 in the form of a flat spiral is provided between the permanent magnet 204 and the rotary member 206 to urge the rotary member 206 with respect to the magnet 204 in a direction of rotation of the member 206. The angular position of the rotary member 206 depends on the magnitude of a current passing through the control winding. The rotary member 206 is mounted on a rotary shaft 212 so that rotation of the member 206 will cause rotation of the shaft 212. One end of the rotary shaft 212 is provided with a cam 214. A spring 216 seats between the housing 22 and the control sleeve 200 to urge the control sleeve 200 axially, in regard to the housing 22, into engagement with the cam 214. The profile of the cam 214 is chosen so that rotation of the cam 214 due to rotation of the shaft 212 will vary the axial position of the control sleeve 200. In this way, the axial position of the control sleeve 200 depends on the magnitude of a current passing through the control winding.

The stationary magnet 204 and the rotary member 206 are disposed within a casing 220 attached to the housing 22. The interior of the casing 220 communicates with the chamber 23 via a suitable passage (not designated) to be supplied with fuel, which cools the magnet 204 and the member 206.

An angular or rotational position sensor 222 is associated with the rotary member 206 or the rotary shaft 212 to detect the angular position of the rotary member 206 relative to the stationary magnet 206 representing the axial position of the control sleeve 200, that is, the actual value of fuel injection quantity. The sensor 222 generates a signal representing the actual value of fuel injection quantity. A control unit (not shown) determines a desired value of fuel injection quantity in response to the engine speed and the engine load, and generates a primary control signal representing the desired value of fuel injection quantity. A servo circuit (not shown) generates a secondary control signal in response to the signals from the sensor 222 and the control unit representing the actual and the desired values of fuel injection quantity. The secondary control signal is applied to the control winding to adjustably determine the magnitude of a current passing through the control winding. In other words, the magnitude of a current passing through the control winding varies as a function of the actual and the desired values of fuel injection quantity. The secondary control signal is designed so that the actual value of fuel injection quantity will follow and equal the desired value of fuel injection quantity. Specifically, the servo circuit includes a difference amplifier which generates a signal indicative of the difference between the actual and the desired values of fuel injection quantity. On the basis of this difference signal, the servo circuit makes the secondary control signal.

Other parts of the second embodiment are designed in a manner essetially similar to those of the first embodiment, so that the description of these parts of the second embodiment can be omitted.

What is claimed is:

1. A fuel injection pump for an internal combustion engine having a rotatable crankshaft and a combustion chamber, the injection pump comprising:

(a) a first plunger pump for injecting fuel into the combustion chamber during first periodical compression strokes as the crankshaft rotates;

(b) a second plunger pump for injecting fuel into the combustion chamber during second periodical compression strokes as the crankshaft rotates, the maximum quantity of fuel injected by the second plunger during each of the second compression strokes being smaller than the maximum quantity of fuel injected by the first plunger pump during each of the first compression strokes;

(c) means for sensing load on the engine; and (d) means, responsive to the sensed engine load, for advancing the timing of the first compression strokes relative to the timing of the second compression strokes with respect to the rotational angle of the crankshaft as the sensed engine load increases to vary the rate of the sum of the fuel injections effected by the first and second plunger pumps;

(e) whereby the characteristic curve of the rate of the sum of the fuel injections effected by the first and second plunger pumps with respect to the rotational angle of the crankshaft can vary in accordance with the engine load.

2. A fuel injection pump for an internal combustion engine having a rotatable crankshaft and a combination chamber, the injection pump comprising:

a first plunger pump for injecting fuel into the combustion chamber during first periodical compression strokes as the crankshaft rotates;

a second plunger pump for injecting fuel into the combustion chamber during second periodical compression strokes as the crankshaft rotates, the maximum quantity of fuel injected by the second plunger during each of the second compression strokes being smaller than the maximum quantity of fuel injected by the first plunger pump during each of the first compression strokes;

means for sensing a load on the engine;

means, responsive to the sensed engine load, for advancing the timing of the first compression strokes relative to the timing of the second compression strokes with respect to the rotational angle of the crankshaft as the sensed engine load increases;

whereby the characteristic curve of the rate of the sum of the fuel injections effected by the first and second plunger pumps with respect to the rotational angle of the crankshaft can vary in accordance with the engine load;

a rotor coupled to the crankshaft to rotate about the axis of the rotor as the crankshaft rotates, the rotor constituting part of both of the first and second plunger pumps;

a reservoir chamber supplied with fuel;

a first pumping chamber formed in the rotor and constituting part of the first plunger pump;

means for expanding and contracting the first pumping chamber as the crankshaft rotates;

means for directing fuel from the reservoir chamber toward the first pumping chamber as the first pumping chamber expands;

means for directing fuel from the first pumping chamber toward the combustion chamber to effect fuel injection as the first pumping chamber contracts;

a second pumping chamber formed in the rotor and constituting part of the second plunger pump;

means for expanding and contracting the second pumping chamber as the crankshaft rotates;

means for directing fuel from the reservoir chamber to the second pumping chamber as the second pumping chamber expands;

means for directing fuel from the second pumping chamber toward the combustion chamber to effect fuel injection as the second pumping chamber contracts;

a relief passage extending from the first and second pumping chambers to the periphery of the rotor to open onto the periphery of the rotor, the open end of the relief passage extending obliquely with respect to the axis of the rotor;

a control member slidably mounted on the rotor for blocking the open end of the relief passage, the control member having a relief port leading to the reservoir chamber, the relief port permitted to periodically move into and out of communication with the open end of the relief port as the rotor rotates, whereby the fuel injection into the combustion chamber is enabled when the open end of the relief passage is blocked by the control member and is disabled when the open end of the relief passage is connected via the relief port to the reservoir chamber to allow fuel to return from the first and second pumping chambers to the reservoir chamber, the total quantity of fuel injection effected by both of the first and second plunger pumps depending on the axial position of the control member relative to the rotor; and means for adjusting the axial position of the control member.

3. A fuel injection pump as recited in claim 2, wherein the control-member position adjusting means comprises:

(a) a housing for supporting the rotor while allowing rotation of the rotor;

(b) a spring urging the control member with respect to the housing in an axial direction of the rotor;

(c) an electric motor; and (d) means for mechanically connecting the motor to the control member to enable the motor to move the control member axially.

4. A fuel injection pump as recited in claim 3, wherein the mechanically connecting means includes a linearly movable shaft actuated by the motor, the control member being coupled to the linearly movable shaft.

5. A fuel injection pump as recited in claim 3, wherein the mechanically connecting means includes a rotary shaft and a cam mounted on the rotary shaft, the rotary shaft being actuated by the motor, the cam engaging the control member to move the control member axially as the rotary shaft rotates.

6. A fuel injection pump for an internal combustion engine having a rotatable crankshaft and a combustion chamber, the injection pump comprising:

(a) a first plunger pump for injecting fuel into the combustion chamber during first periodical compression strokes as the crankshaft rotates;

(b) a second plunger pump for injecting fuel into the combustion chamber during second periodical compression strokes as the crankshaft rotates, the maximum quantity of fuel injected by the second plunger during each of the second compression strokes being smaller than the maximum quantity of fuel injected by the first plunger pump during each of the first compression strokes;

(c) means for sensing a load on the engine; and (d) means, responsive to the sensed engine load, for advancing the timing of the first compression strokes relative to the timing of the second compression strokes with respect to the rotational angle of the crankshaft as the sensed engine load increases;

whereby the characteristic curve of the rate of the sum of the fuel injections effected by the first and second plunger pumps with respect to the rotational angle of the crankshaft can vary in accordance with the engine load;

wherein the duration of each of the first compression strokes in units of the rotational angle of the crankshaft is shorter than the duration of each of the second compression strokes.

7. A fuel injection pump as recited in claim 6, further comprising:

(a) a rotor coupled to the crankshaft to rotate about the axis of the rotor as the crankshaft rotates, the rotor constituting part of both of the first and second plunger pumps;

(b) a reservoir chamber supplied with fuel;

(c) a first pumping chamber formed in the rotor and constituting part of the first plunger pump;

(d) means for expanding and contracting the first pumping chamber as the crankshaft rotates;

(e) means for directing fuel from the reservoir chamber toward the first pumping chamber as the first pumping chamber expands;

(f) means for directing fuel from the first pumping chamber toward the combustion chamber to effect fuel injection as the first pumping chamber contracts;

(g) a second pumping chamber formed in the rotor and constituting part of the second plunger pump;

(h) means for expanding and contracting the second pumping chamber as the crankshaft rotates;

(i) means for directing fuel from the reservoir chamber to the second pumping chamber as the second pumping chamber expands;

(j) means for directing fuel from the second pumping chamber toward the combustion chamber to effect fuel injection as the second pumping chamber contracts;

(k) a relief passage extending from the first and second pumping chambers to the periphery of the rotor to open onto the periphery of the rotor, the open end of the relief passage extending obliquely with respect to the axis of the rotor;

(l) a control member slidably mounted on the rotor for blocking the open end of the relief passage, the control member having a relief port leading to the reservoir chamber, the relief port permitted to periodically move into and out of communication with the open end of the relief port as the rotor rotates, whereby the fuel injection into the combustion chamber is enabled when the open end of the relief passage is blocked by the control member and is disabled when the open end of the relief passage is connected via the relief port to the reservoir chamber to allow fuel to return from the first and second pumping chambers to the reservoir chamber, the total quantity of fuel injection effected by both of the first and second plunger pumps depending on the axial position of the control member relative to the rotor; and (m) means for adjusting the axial position of the control member.

8. A fuel injection pump as recited in claim 7, wherein the control-member position adjusting means comprises:

(a) a housing for supporting the rotor while allowing rotation of the rotor;

(b) a spring urging the control member with respect to the housing in an axial direction of the rotor;

(c) an electric motor; and (d) means for mechanically connecting the motor to the control member to enable the motor to move the control member axially.

9. A fuel injection pump as recited in claim 7, wherein the mechanically connecting means includes a linearly movable shaft actuated by the motor, the control member being coupled to the linearly movable shaft.

10. A fuel injection pump as recited in claim 7, wherein the mechanically connecting means includes a rotary shaft and a cam mounted on the rotary shaft, the rotary shaft being actuated by the motor, the cam engaging the control member to move the control member axially as the rotary shaft rotates.

* * * * *